US009518703B2

(12) United States Patent
Quail

(10) Patent No.: US 9,518,703 B2
(45) Date of Patent: Dec. 13, 2016

(54) DISPOSABLE COMPRESSED GAS CARTRIDGE WITH INTEGRAL SEALING MEMBER

(71) Applicant: Jeffrey James Quail, St. Andrews (CA)

(72) Inventor: Jeffrey James Quail, St. Andrews (CA)

( * ) Notice: Subject to any disclaimer, the term of this patent is extended or adjusted under 35 U.S.C. 154(b) by 203 days.

(21) Appl. No.: 14/339,634

(22) Filed: Jul. 24, 2014

(65) Prior Publication Data

US 2016/0025269 A1 Jan. 28, 2016

(51) Int. Cl.
*F17C 13/06* (2006.01)
*F17C 1/00* (2006.01)

(52) U.S. Cl.
CPC ..... *F17C 13/06* (2013.01); *F17C 1/00* (2013.01); *F17C 2201/058* (2013.01); *F17C 2203/0617* (2013.01); *F17C 2205/032* (2013.01); *F17C 2205/0335* (2013.01); *F17C 2209/234* (2013.01); *F17C 2270/0736* (2013.01)

(58) Field of Classification Search
CPC ..... F17C 2205/032; F17C 13/06; F17C 2201/058
USPC ..... 141/19, 329–330; 222/5; 220/277, 583; 215/251, 250
See application file for complete search history.

(56) References Cited

U.S. PATENT DOCUMENTS

| | | | | |
|---|---|---|---|---|
| 2,613,849 | A | 10/1952 | Ward | |
| 6,843,388 | B1 * | 1/2005 | Hollars | F17C 13/06 222/183 |
| 8,925,756 | B2 * | 1/2015 | Tarapata | F16J 15/02 215/247 |
| 9,016,502 | B2 * | 4/2015 | Hollars | F17C 13/06 220/258.4 |

* cited by examiner

*Primary Examiner* — Timothy L Maust
*Assistant Examiner* — Timothy P Kelly
(74) *Attorney, Agent, or Firm* — Ryan W. Dupuis; Kyle R. Saitterhwaite; Ade & Company Inc.

(57) ABSTRACT

A disposable compressed gas cartridge has an envelope formed of a cylindrical wall portion, an end wall portion enclosing a first end of the cylindrical wall portion, a neck portion formed at a second end of the cylindrical wall portion, and a membrane spanning across the neck portion such that the envelope is arranged to contain gas under pressure therein. A resilient sealing member is integrally and externally supported on the second end of the envelope so as to abut the seat surface about a charging pin of a compressed gas consuming device. Sealing engagement between the cartridge and the device being charged with compressed gas by the cartridge is provided primarily by the sealing member on the cartridge which is replaced together with the cartridge to always ensure that the sealing between the cartridge and the device is accomplished with a new and effective sealing member.

11 Claims, 7 Drawing Sheets

DISPOSABLE COMPRESSED GAS CARTRIDGE WITH INTEGRAL SEALING MEMBER

FIELD OF THE INVENTION

The present invention relates to a disposable compressed gas cartridge of the type commonly used for charging various compressed gas consuming devices, and more particularly the present invention relates to a disposable compressed gas cartridge which can be sealed relative to the compressed gas consuming device being charged using a resilient sealing element which is integrally supported on the cartridge instead of or in addition to a resilient sealing element on the compressed gas consuming device.

BACKGROUND

Various compressed gas consuming devices are known which are periodically charged with compressed gas using a replaceable compressed gas cartridge. Typically the cartridge is cylindrical tube with closed first end and puncturable membrane across neck opening at an opposing second end. The membrane is punctured with a charging pin on the compressed gas consuming device to permit the charge of compressed gas to be dispensed from the cartridge into the compressed gas consuming device. The cartridge is then removed from the device and disposed of. To prevent leakage and undesirable loss of compressed gas while charging the compressed gas consuming device, a resilient seal is typically provided on the device which is abutted by a rigid end face of the cartridge. These seals however are known to degrade over time resulting in leakage losses. Replacement of the sealing member on the compressed gas consuming device can require complex disassembly of the device.

U.S. Pat. No. 2,613,849 discloses one example of a compressed gas cartridge which primarily relies on first resilient seal mounted on the compressed gas consuming device in the usual manner, but which also includes a tubular resilient seal received internally within the neck of the cartridge for sealing engagement about the cylindrical side wall of the charging pin. The tubular sealing member has limited application though as it must be sized to match the specific configuration of the charging pin of a particular compressed gas consuming device to be effective.

SUMMARY OF THE INVENTION

According to one aspect of the invention there is provided a disposable compressed gas cartridge in combination with a compressed gas consuming device having a charging pin extending in a longitudinal direction and a seat surface about the charging pin which is transverse to the longitudinal direction, the disposable compressed gas cartridge comprising:

a cartridge envelope which is extends longitudinally between a first end and a second end thereof, the cartridge envelope including:

- a generally cylindrical wall portion defining a hollow chamber therein;
- an end wall portion enclosing the generally cylindrical wall portion at the first end of the cartridge envelope;
- a neck portion formed on the generally cylindrical wall portion at the second end of the cartridge envelope in which the neck portion defines a neck passage therethrough in communication with the hollow chamber of the generally cylindrical wall portion; and

- a membrane spanning across the neck passage of the neck portion such that the cartridge envelope is arranged to contain gas under pressure therein, the membrane being arranged to be punctured by the charging pin of the compressed gas consuming device; and a resilient sealing member supported on the cartridge envelope and including an external sealing surface which is arranged to abut the seat surface about the charging pin of the compressed gas consuming device when puncturing the membrane with the charging pin.

According to a second aspect of the present invention there is provided a method of delivering a charge of compressed gas to the compressed gas consuming device noted above, the method including the steps of: i) inserting the disposable compressed gas cartridge noted above into the compressed gas consuming device such that the resilient sealing member abuts the seat surface about the charging pin of the compressed gas consuming device; and ii) puncturing the membrane of the disposable compressed gas cartridge with the charging pin of the compressed gas consuming device. Preferably the method subsequently includes removing the resilient sealing member together with the cartridge envelope from the compressed gas consuming device.

By locating a flat sealing member on the cartridge at an exterior end face of the cartridge, the sealing member can effectively seal the cartridge relative to the sealing surface about a charging pin of a compressed gas consuming device in a manner which permits the sealing member to be automatically replaced with the compressed gas cartridge with each charging of the compressed gas consuming device. Accordingly there is no concern for leakage losses resulting from degrading seals on the compressed gas consuming device as in prior art methods of charging a compressed gas consuming device using conventional cartridges.

Preferably the external sealing surface is generally flat and perpendicular to a longitudinal direction of the cartridge envelope.

Preferably the sealing member is supported on an outermost end face of the cartridge envelope such that an entirety of the resilient sealing member is supported externally of the cartridge envelope. The resilient sealing member may be retained solely by adhesive bonding to the cartridge envelope. In some embodiments the seat surface of the compressed gas consuming device is a flat, planar, rigid, and non-resilient surface which is perpendicular to the longitudinal direction of the charging pin.

In some embodiments, the resilient sealing member is an annular member including a central opening arranged to receive the charging pin therethrough. In further embodiments, the resilient sealing member may alternatively fully span the membrane at the second end of the cartridge envelope such that the resilient sealing member is arranged to be punctured by the charging pin together with the membrane.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
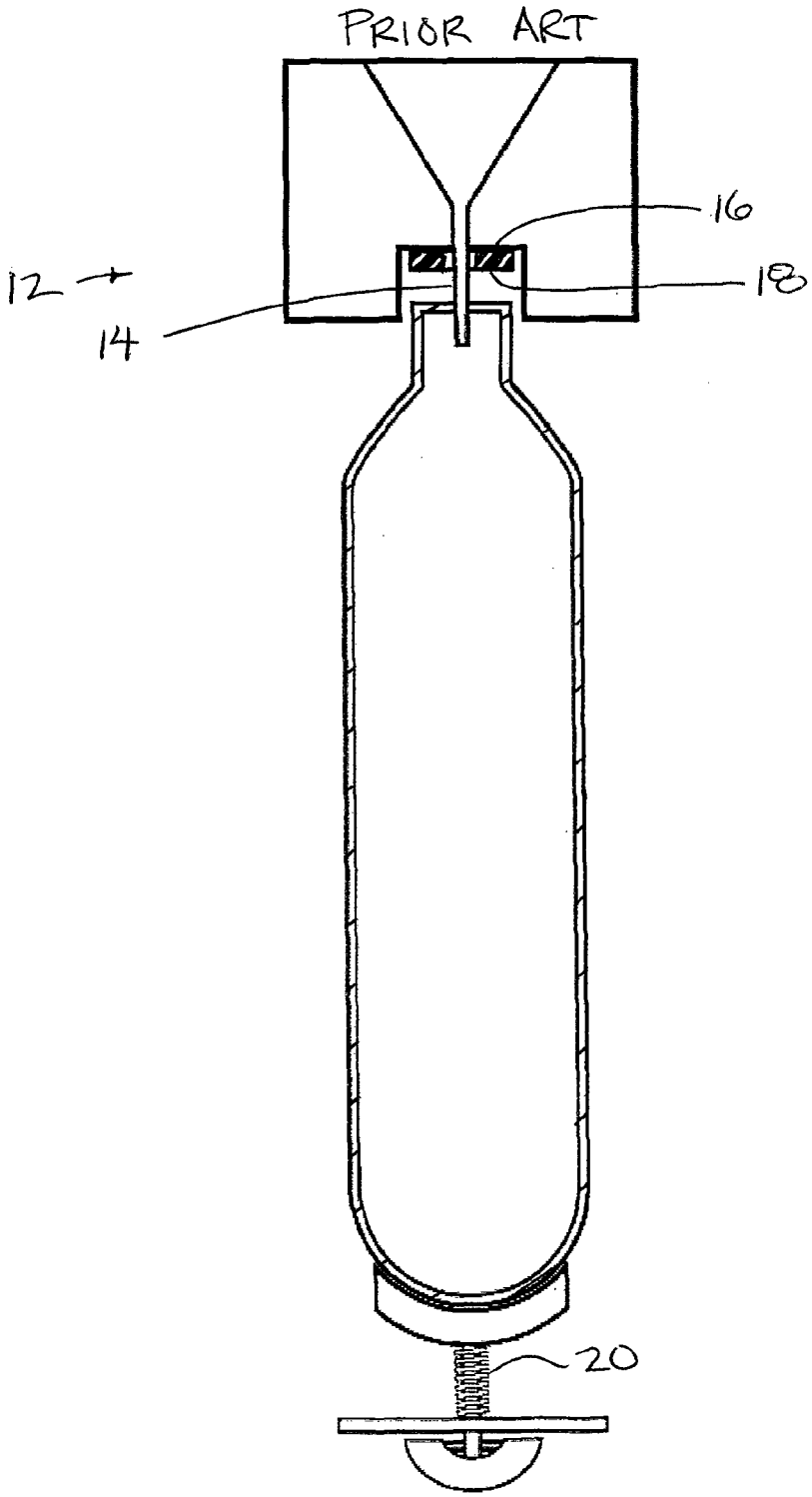
FIG. 1 is sectional view of a disposable compressed gas cartridge being loaded into a compressed gas consuming device according to prior art arrangements.

Referring to the accompanying figures, there is illustrated a disposable compressed gas cartridge generally indicated by reference numeral 10. The cartridge 10 is particularly suited for use with a compressed gas consuming device 12.

The device 12 typically includes a receptacle into which the disposable cartridge can be inserted. Means are provided on the device for containing compressed gas released by the cartridge for subsequent use of the device. Typically, this is accomplished using a charging valve, for example a one way check valve which permits dispensing of the charged gas from the cartridge into a pressure chamber of the device.

Figure 2:
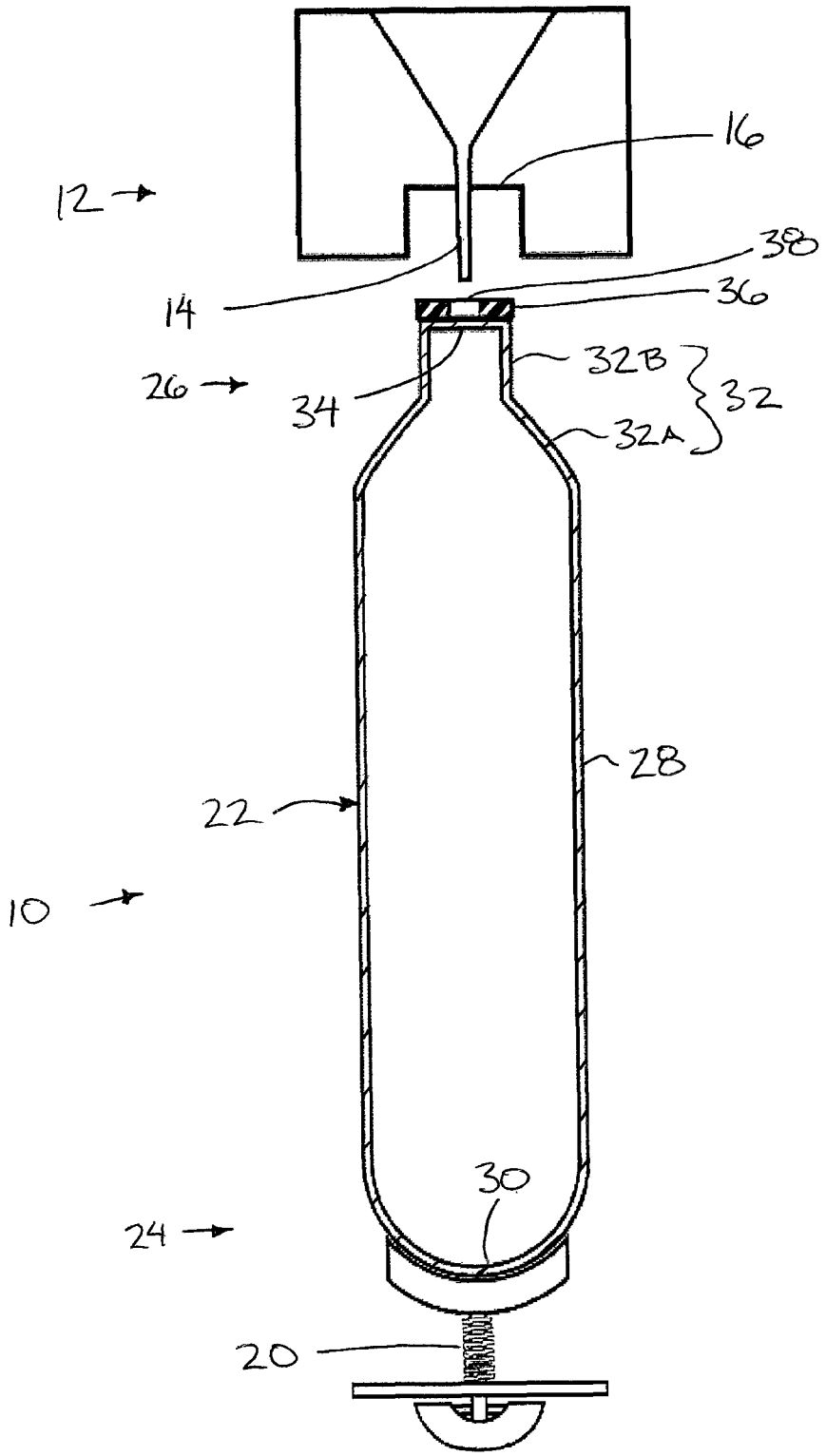
FIG. 2 is sectional view of a disposable compressed gas cartridge according to the present invention prior to being loaded into a compressed gas consuming device.
Figure 3:
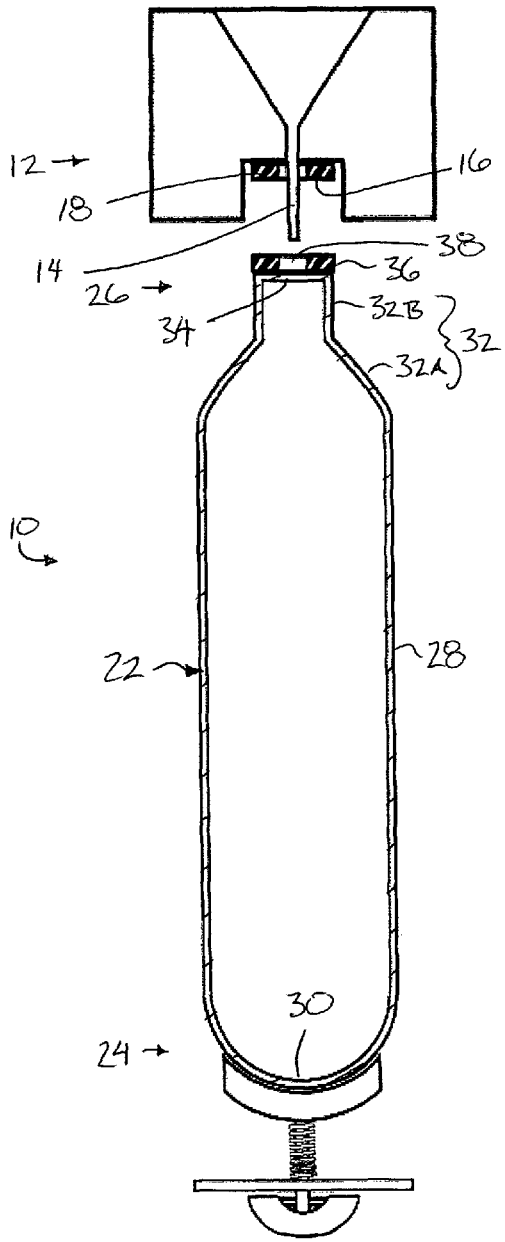
FIG. 3 and FIG. 4 are sectional views of the cartridge according to the present invention at different stages of being loaded into a different configuration of compressed gas consuming device.
Figure 4:
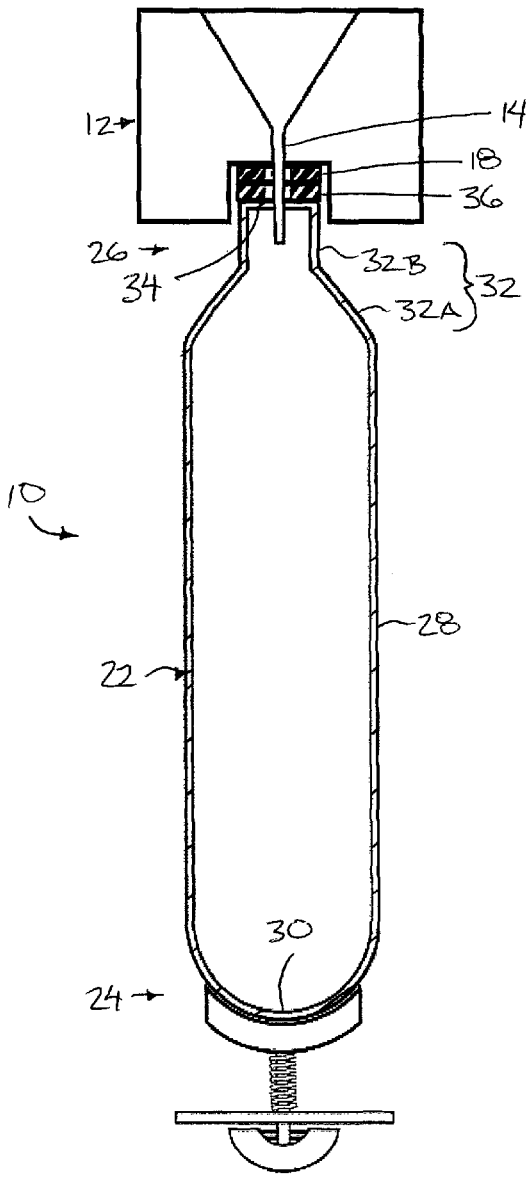
Figure 5:
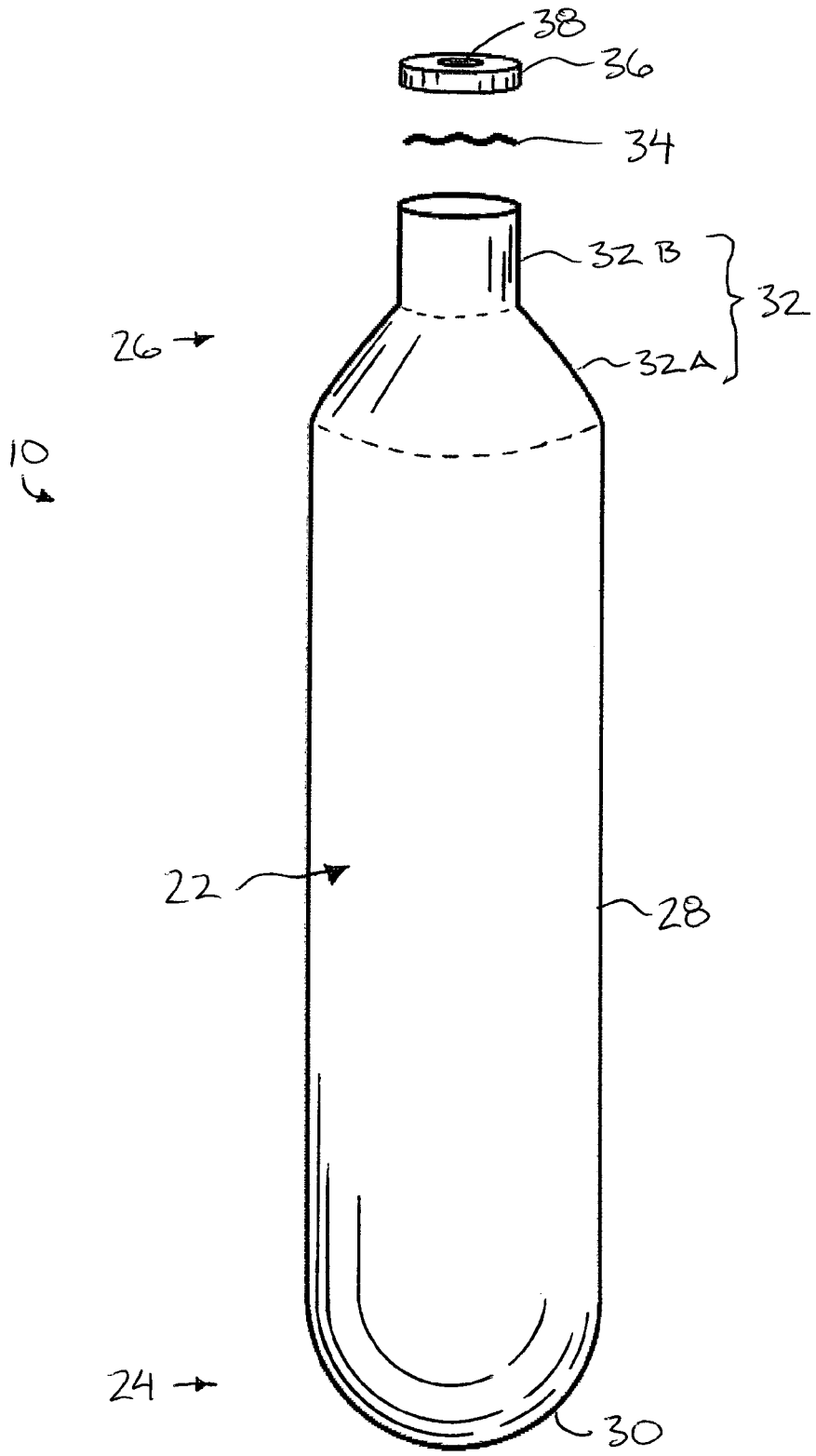
FIG. 5 is an exploded perspective view of a first embodiment of the cartridge.
Figure 8:
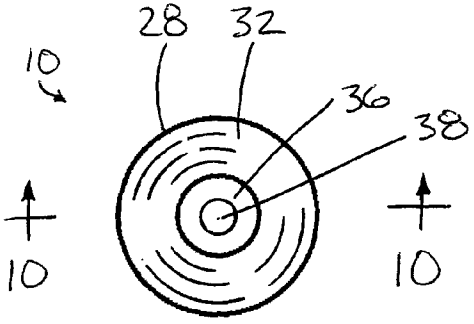
FIG. 8 is a top plan view of the cartridge according to the first embodiment of FIG. 5.
Figure 9:
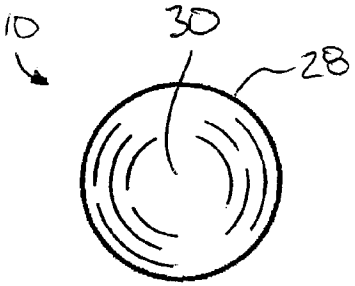
FIG. 9 is a bottom plan view of the cartridge according to the first embodiment of FIG. 5.
Figure 7:
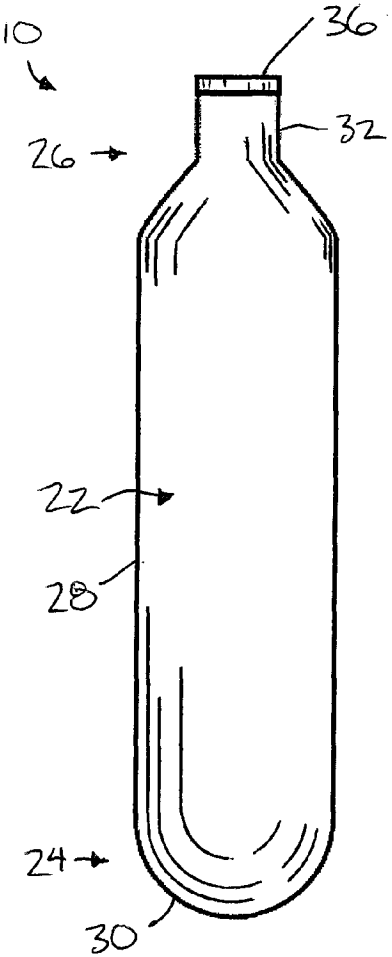
FIG. 7 is a front view of the cartridge according to the first embodiment of FIG. 5, in which the rear view and the side views are substantially identical to the front view shown.
Figure 6:
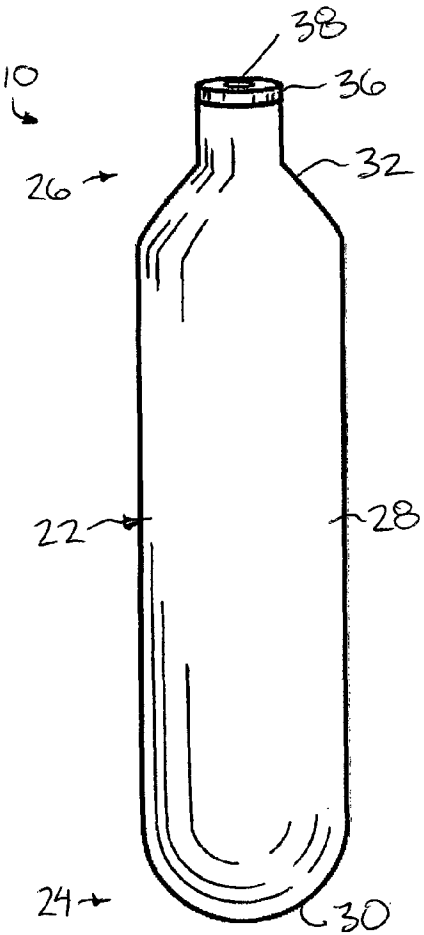
FIG. 6 is a perspective view of the assembled cartridge according to the first embodiment of FIG. 5.
Figure 15:
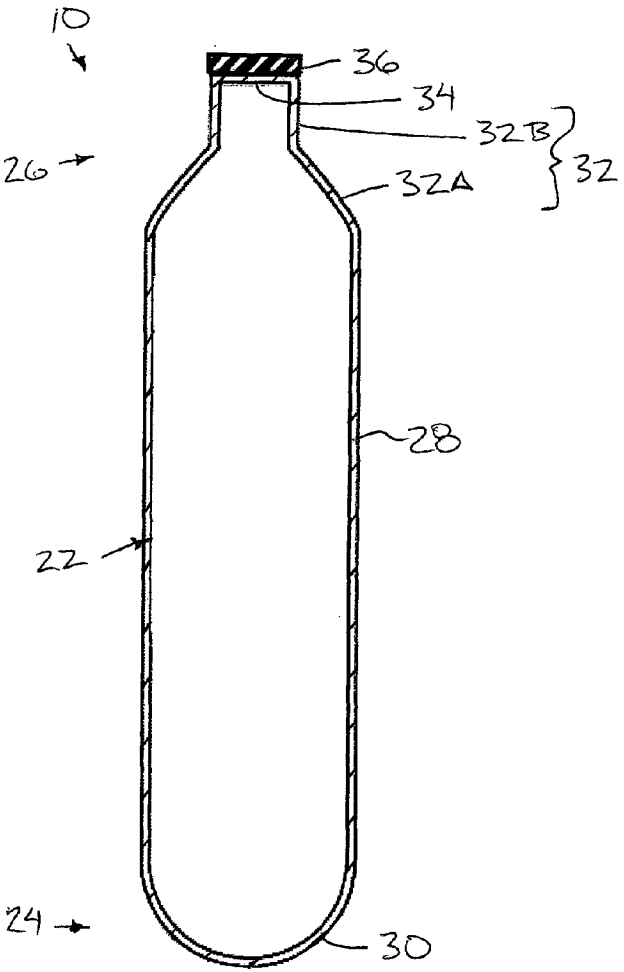
FIG. 15 is a partial sectional view along the line 15-15 of FIG. 13.
Figure 10:
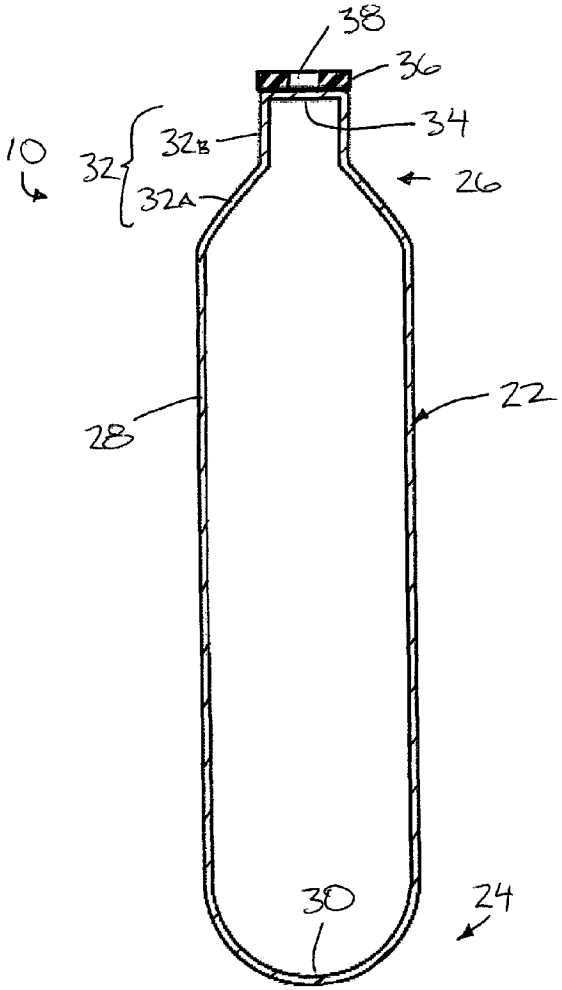
FIG. 10 is a partial sectional view along the line 10-10 of FIG. 8.
Figure 13:
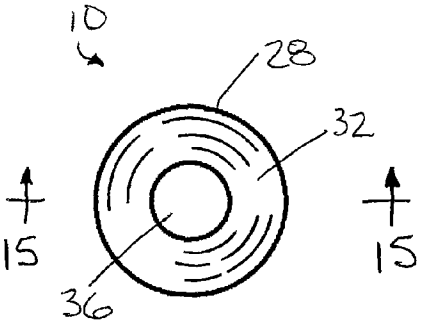
FIG. 13 is a top plan view of the cartridge according to the second embodiment of FIG. 11.
Figure 14:
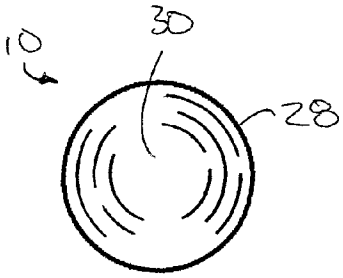
FIG. 14 is a bottom plan view of the cartridge according to the second embodiment of FIG. 11.
Figure 12:
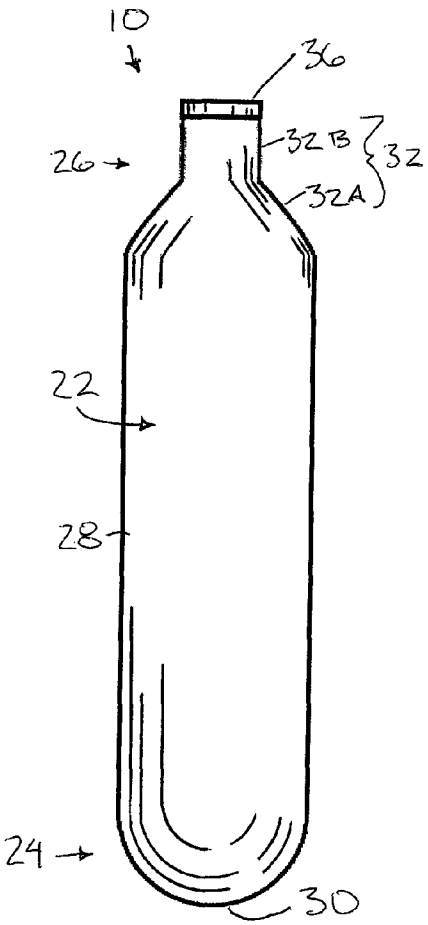
FIG. 12 is a front view of the cartridge according to the second embodiment of FIG. 11, in which the rear view and the side views are substantially identical to the front view shown.
Figure 11:
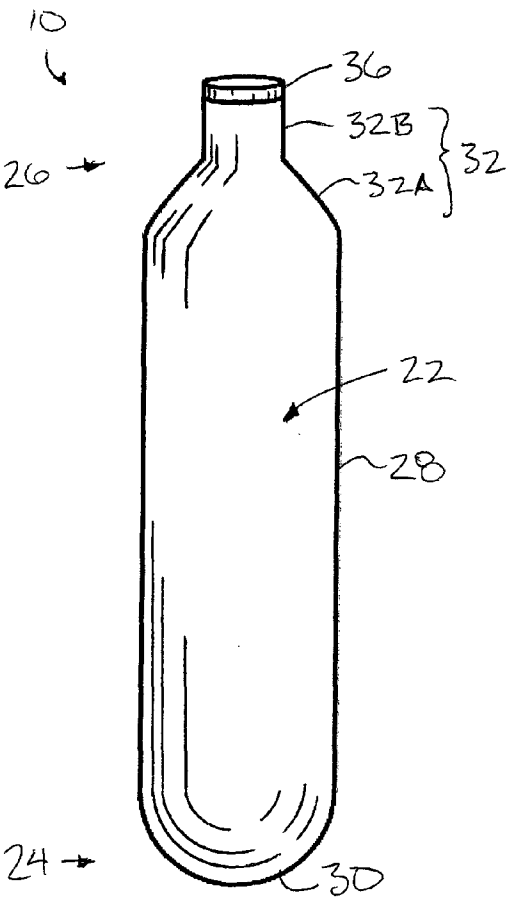
FIG. 11 is a perspective view of a second embodiment of the cartridge.

To release the pressurized gas from the cartridge, the device 12 typically includes a charging pin 14 in the form of a hollow rigid tube extending in a longitudinal direction to communicate the gas therethrough from the cartridge to the pressure containment chamber of the device. A seat surface 16 is provided about the charging pin 14. The seat surface is intended for sealing abutment against an end face of the cartridge to prevent leakage losses of gas when charging the gas from the cartridge to the device. As shown in FIG. 2, the seat surface is a flat, rigid, annular surface about the pin 14 so as to be oriented generally perpendicularly to the longitudinal direction of the pin.

Alternatively in some instances an additional gasket 18 may be provided about the charging pin such that the outer end face of the gasket defines the seat surface against which the cartridge is abutted. Use of a gasket 18 is common in conventional devices intended to be charged with conventional cartridges having no integral sealing ability on the cartridge.

The device 12 further includes a loading mechanism 20, for example a screw, spring or clamp-type structure, which urges the cartridge into engagement against the seat surface 16 of the device. The charging pin 14 may also be supported by a suitable mechanism such that the pin is moveable relative to the seat surface between a retracted position where the cartridge can be sealed against the seat surface without puncturing or dispensing gas therefrom, and an extended position in which the charging pin protrudes into the cartridge to dispense the gas therefrom. In this manner, the cartridge can be sealed against the seat surface prior to releasing of the compressed gas therefrom.

Although two embodiments of the cartridge 10 are shown in the accompanying figures, the common features of the two embodiments will first be described. In each instance, the cartridge includes a cartridge envelope 22 which extends longitudinally between a first end 24 and a second end 26. The envelope includes a cylindrical wall portion 28 which is generally cylindrical and defines the majority of the internal hollow chamber of the cartridge therein. An end wall 30 encloses the cylindrical wall portion at the first end thereof. The end wall 30 is semi-spherical in shape and is formed together with the cylindrical wall portion as an integral, seamless and unitary body together therewith.

The envelope 32 further includes a neck portion 32 formed on the second end of the cylindrical wall portion. The neck portion includes a first part 32A which is generally frusto-conical in shape so as to be reduced in diameter in the longitudinal direction of the cartridge from a first diameter corresponding to the cylindrical wall portion to a second reduced diameter towards the second end of the envelope. A second part 32B of the neck portion is generally cylindrical so as to be constant in diameter along the length thereof. The overall neck portion 32 is hollow to define a neck passage extending therethrough in communication with the remainder of the hollow chamber within the interior of the cartridge envelope.

The envelope further includes membrane 34 which fully spans across the neck passage at the outermost second end of the envelope. The membrane is typically a metallic member which has a thickness which is reduced compared to the remaining wall portions of the envelope. In this manner, the membrane is suitable for being punctured by the charging pin 14 of the compressed gas consuming device 12.

The cartridge 10 further includes a resilient sealing member 36 which is integrally supported on the envelope at the second end of the cartridge. The sealing member is a resilient material, for example rubber, so as to be suitable for providing a fluid tight seal between the cartridge envelope and the body of the device 12 about the charging pin 14. Typically, the sealing member 36 is a flat, planar body which is adhesively bonded to the exterior side of the membrane such that the sealing member is fully and entirely supported to the exterior of the envelope. An outer diameter of the body is substantially equal to the outer diameter of the second part 32B of the neck portion 32 of the envelope.

Turning now to the first embodiment of FIGS. 5 through 10, the resilient sealing member 36 in this instance is generally annular in shape about a central opening 38 formed therein. The central opening 38 communicates fully through the body of the sealing member in the longitudinal direction of the cartridge so as to permit the charging pin to be received therethrough when piercing the membrane with the charging pin.

Alternatively, as shown in the second embodiment of FIGS. 11 through 15, the sealing member 36 in this instance may comprise a circular disc which fully spans the outer side of the membrane forming the outermost end wall at the second end of the cartridge envelope. In this instance, the resilient sealing member is punctured by the charging pin 14 simultaneously with the membrane.

In either embodiment, charging of the compressed gas consuming device 12 involves providing a cartridge 10 as described above having a resilient sealing member supported at the outermost exterior end of the cartridge envelope. When loading the cartridge into the device 12, the sealing member provides sealing engagement between the cartridge and the body of the device 12 surrounding the charging pin to permit the compressed gas being dispensed from the cartridge into the device 12 to be fully contained within the device 12 and the cartridge 10.

Once the compressed gas has been dispensed from the cartridge to the device 12, the cartridge is removed from the device 12 with the resilient sealing member 36 remaining integrally supported on the cartridge envelope such that it is removed together with the cartridge from the compressed gas consuming device 12. When subsequently charging the device with a new charge of compressed gas from another disposable cartridge, the next cartridge will similarly include a resilient sealing member 36 integrally supported thereon such that a new fresh resilient sealing member is used for each charging of the device to ensure minimal leakage losses which might otherwise result from a degraded seal integrally supported on the compressed gas consuming device 12 which degrades after many uses.

Since various modifications can be made in my invention as herein above described, it is intended that all matter contained in the accompanying specification shall be interpreted as illustrative only and not in a limiting sense.

The invention claimed is:

1. A disposable compressed gas cartridge in combination with a compressed gas consuming device having a charging pin extending in a longitudinal direction and a seat surface about the charging pin which is transverse to the longitudinal direction, the disposable compressed gas cartridge comprising:

a cartridge envelope which extends longitudinally between a first end and a second end thereof, the cartridge envelope including:

a generally cylindrical wall portion defining a hollow chamber therein;

an end wall portion enclosing the generally cylindrical wall portion at the first end of the cartridge envelope;

a neck portion formed on the generally cylindrical wall portion at the second end of the cartridge envelope in which the neck portion defines a neck passage therethrough in communication with the hollow chamber of the generally cylindrical wall portion, the neck portion having a cylindrical portion of prescribed diameter locating an outermost end face of the envelope thereon; and a membrane spanning across the neck passage of the neck portion at the outermost end face of the envelope such that the cartridge envelope is arranged to contain gas under pressure therein, the membrane being arranged to be punctured by the charging pin of the compressed gas consuming device; and a resilient sealing member supported entirely on the outermost end face of the cartridge envelope by adhesive between the resilient sealing member and the outermost end face of the cartridge envelope and including an external sealing surface which is arranged to abut the seat surface about the charging pin of the compressed gas consuming device when puncturing the membrane with the charging pin;

wherein the resilient sealing member includes an outer diameter which is equal to the prescribed diameter of the cylindrical portion of the neck portion of the cartridge envelope.

2. The combination according to claim 1 wherein the external sealing surface is generally flat and perpendicular to a longitudinal direction of the cartridge envelope.

3. The combination according to claim 1 wherein the seat surface of the compressed gas consuming device is a flat, planar surface.

4. The combination according to claim 1 wherein the seat surface of the compressed gas consuming device is perpendicular to the longitudinal direction of the charging pin.

5. The combination according to claim 1 wherein the seat surface of the compressed gas consuming device is a rigid, non-resilient surface.

6. The combination according to claim 1 wherein the resilient sealing member is an annular member including a central opening arranged to receive the charging pin therethrough.

7. The combination according to claim 1 wherein the resilient sealing member fully spans the membrane at the second end of the cartridge envelope, the resilient sealing member being arranged to be punctured by the charging pin together with the membrane.

8. A method of delivering a charge of compressed gas to a compressed gas consuming device according to claim 1, the method comprising:

inserting a disposable compressed gas cartridge according to claim 1 into the compressed gas consuming device such that the resilient sealing member abuts the seat surface about the charging pin of the compressed gas consuming device; and puncturing the membrane of the disposable compressed gas cartridge with the charging pin of the compressed gas consuming device.

9. The method according to claim 8 wherein the seat surface of the compressed gas consuming device is a rigid, non-resilient seat surface oriented generally perpendicularly to the longitudinal direction, the method further comprising abutting the resilient sealing member of the disposable compressed gas cartridge against said rigid, non-resilient seat surface of the compressed gas consuming device.

10. The method according to claim 8 including subsequently removing the resilient sealing member together with the cartridge envelope from the compressed gas consuming device.

11. A disposable compressed gas cartridge in combination with a compressed gas consuming device having a charging pin extending in a longitudinal direction and a seat surface about the charging pin which is transverse to the longitudinal direction, the disposable compressed gas cartridge consisting solely of:

i) a cartridge envelope which extends longitudinally between a first end and a second end thereof, the cartridge envelope including:

a generally cylindrical wall portion defining a hollow chamber therein;

an end wall portion enclosing the generally cylindrical wall portion at the first end of the cartridge envelope;

a neck portion formed on the generally cylindrical wall portion at the second end of the cartridge envelope in which the neck portion defines a neck passage therethrough in communication with the hollow chamber of the generally cylindrical wall portion, the neck portion having a cylindrical portion of prescribed diameter locating an outermost end face of the envelope thereon; and a membrane spanning across the neck passage of the neck portion at the outermost end face of the envelope such that the cartridge envelope is arranged to contain gas under pressure therein, the membrane being arranged to be punctured by the charging pin of the compressed gas consuming device; and ii) a resilient sealing member supported entirely on the outermost end face of the cartridge envelope by adhesive between the resilient sealing member and the outermost end face of the cartridge envelope such that an outer diameter of the resilient sealing member is equal to the prescribed diameter of the cylindrical portion of the neck portion of the cartridge envelope, the resilient sealing member further comprising an external sealing surface which is arranged to abut the seat surface about the charging pin of the compressed gas consuming device when puncturing the membrane with the charging pin.

* * * * *